US012768345B2

(12) United States Patent
Davis et al.

(10) Patent No.: US 12,768,345 B2
(45) Date of Patent: Oct. 20, 2026

(54) PARALLEL PUMPING CONTROLLER WITH LOAD SHARING AND SYSTEMS INCLUDING THE SAME

(71) Applicant: Cattron North America, Inc., Warren, OH (US)

(72) Inventors: Brett Allen Davis, Roswell, GA (US); Christopher Brian Perry, Roswell, GA (US); John Edward Geertsema, Jr., Roswell, GA (US)

(73) Assignee: Cattron North America, Inc., Warren, OH (US)

( * ) Notice: Subject to any disclaimer, the term of this patent is extended or adjusted under 35 U.S.C. 154(b) by 0 days.

(21) Appl. No.: 19/341,109

(22) Filed: Sep. 26, 2025

(65) Prior Publication Data

US 2026/0022696 A1 Jan. 22, 2026

Related U.S. Application Data

(63) Continuation of application No. PCT/US2024/019649, filed on Mar. 13, 2024.
(Continued)

(51) Int. Cl.
*F04B 17/05* (2006.01)
*F04B 23/04* (2006.01)
(Continued)

(52) U.S. Cl.
CPC ..... *F04B 49/20* (2013.01); *F04B 17/05* (2013.01); *F04B 23/04* (2013.01); *F04B 49/065* (2013.01); *F04B 2203/0605* (2013.01)

(58) Field of Classification Search
CPC ..... F04B 17/05; F04B 23/04; F04B 49/02; F04B 49/065; F04B 49/20; F04B 2203/06; F04B 2203/0605; F04B 2207/043
See application file for complete search history.

(56) References Cited

U.S. PATENT DOCUMENTS 8,827,660 B2 * 9/2014 Frokjaer ..... F04B 49/20 417/216
11,391,269 B2 * 7/2022 Tanner ..... F04B 17/00
(Continued)

FOREIGN PATENT DOCUMENTS

JP 2003171977 A 6/2003
JP 2023048461 A 4/2023
KR 101609236 B1 4/2016

OTHER PUBLICATIONS

PCT International Search Report and Written Opinion for PCT/US2024/019649 that is the parent application to the instant application; Jul. 15, 2024, 12 pages.

*Primary Examiner* — Dapinder Singh
(74) *Attorney, Agent, or Firm* — Harness, Dickey & Pierce, P.L.C.; Anthony G. Fussner

(57) ABSTRACT

Disclosed are parallel pumping controllers (e.g., control panels, etc.) with load sharing and systems including such parallel pumping controllers. An exemplary system includes first and second controllers. The first controller is configured for communication with a first engine for controlling operation of a first pump via the first engine. The second controller is configured for communication with the second engine for controlling operation of the second pump via the second engine. The first controller is further configured for communication with the second controller, whereby the first controller is operable for controlling operation of the first pump via the first engine and for controlling operation of the second pump via communications with the second controller, which responsively controls operation of the second engine according to the communications from the first controller.

18 Claims, 5 Drawing Sheets

Related U.S. Application Data

(60) Provisional application No. 63/465,765, filed on May 11, 2023.

(51) Int. Cl.
*F04B 49/06* (2006.01)
*F04B 49/20* (2006.01)

(56) References Cited

U.S. PATENT DOCUMENTS

| | | | | |
|---|---|---|---|---|
| 2015/0016948 | A1 | 1/2015 | Bihler et al. | |
| 2020/0376964 | A1 | 12/2020 | Jochman | |
| 2021/0388830 | A1* | 12/2021 | Lubben | B60W 10/30 |
| 2023/0384271 | A1* | 11/2023 | Tsukada | F04B 11/0041 |
| 2024/0360747 | A1* | 10/2024 | Kabrich | F04B 49/20 |

* cited by examiner

PARALLEL PUMPING CONTROLLER WITH LOAD SHARING AND SYSTEMS INCLUDING THE SAME

CROSS-REFERENCE TO RELATED APPLICATIONS

This application is continuation of PCT International Patent Application No. PCT/US2024/019649 filed Mar. 13, 2024 (published as WO 2024/232991 on Nov. 14, 2024), which, in turn, claims the benefit of and priority to U.S. Provisional Patent Application No. 63/465,765 filed May 11, 2023. The entire disclosures of the above applications are incorporated herein by reference.

FIELD

The present disclosure generally relates to parallel pumping controllers (e.g., control panels, etc.) with load sharing and systems including such parallel pumping controllers.

BACKGROUND

This section provides background information related to the present disclosure which is not necessarily prior art.

Pumping applications may require multiple pumps for pumping in parallel due to varying flow demands and/or due to having only an inventory of small pumps. Conventionally, an expensive program logic controller and software is required to provide smart control for managing the multiple pumps to vary the flow. For example, FIG. 1 shows a conventional sewer bypass parallel pumping application in which a programmable logic controller (PLC) is usable for managing four pumps.

FIG. 2 illustrates a conventional pumping system 1 including a first pump 5 and a second pump 9. A first diesel engine 13 mechanically spins the first pump 5 as indicated by the arrow. A second diesel engine 17 mechanically spins the second pump 9 as indicated by the arrow.

The system 1 further includes a first engine controller 21, a second engine controller 25, and a programmable logic controller (PLC) 29. The PLC 29 is in communication with various sensors 33 for monitoring the application. In response to output from the sensors 33 communicated to the PLC 29, the PLC 29 may communicate with the first and second engine controllers 21 and 25 via ModBus data communications protocol.

In response to the communications from the PLC 29, the first and second engine controllers 21 and 25 may respectively control operation of the first and second pumps 5 and 9. More specifically, the first engine controller 21 may send commands to the electronic control unit (ECU) of the first diesel engine 13 for controllably changing the speed of the first diesel engine 13 that is driving the first pump 5. Similarly, the second engine controller 25 may send commands to the electronic control unit (ECU) of the second diesel engine 17 for controllably changing the speed of the second diesel engine 17 that is driving the second pump 9.

DRAWINGS

The drawings described herein are for illustrative purposes only of selected embodiments and not all possible implementations and are not intended to limit the scope of the present disclosure.

FIG. 1 shows a conventional sewer bypass parallel pumping application in which a programmable logic controller (PLC) is usable for managing four pumps. As disclosed herein, the need for the conventional PLC (and its associated application programming) may be eliminated by using a primary/master control panel (broadly, a first controller or first control unit) configured to manage secondary/slave control panel(s) (broadly, second controller(s) or second control unit(s)) according to exemplary embodiments of the present disclosure.

FIG. 2 illustrates a conventional pumping system that includes first and second engine controllers (and associated application programming) for respectively controlling first and second pumps based on or in response to communications from a programmable logic controller (PLC) (and associated application programming) regarding sensor output from various sensors monitoring the pumping application.

FIG. 3 illustrates an exemplary embodiment of a system including a primary/master controller configured to communicate with and manage a secondary/slave controller. In this exemplary embodiment, the primary/master controller is configured to control operation (e.g., start, stop, throttle speed, etc.) of a first pump. The primary/master controller is also configured to communicate directly with the secondary/slave controller for controlling operation (e.g., start, stop, throttle speed, etc.) of a second pump, e.g., for ensuring that the first and second diesel engines are substantially evenly used for load sharing (e.g., used substantially the same amount of time, etc.).

Corresponding reference numerals may indicate corresponding (though not necessarily identical) parts throughout the several views of the drawings.

DETAILED DESCRIPTION

Figure 1:
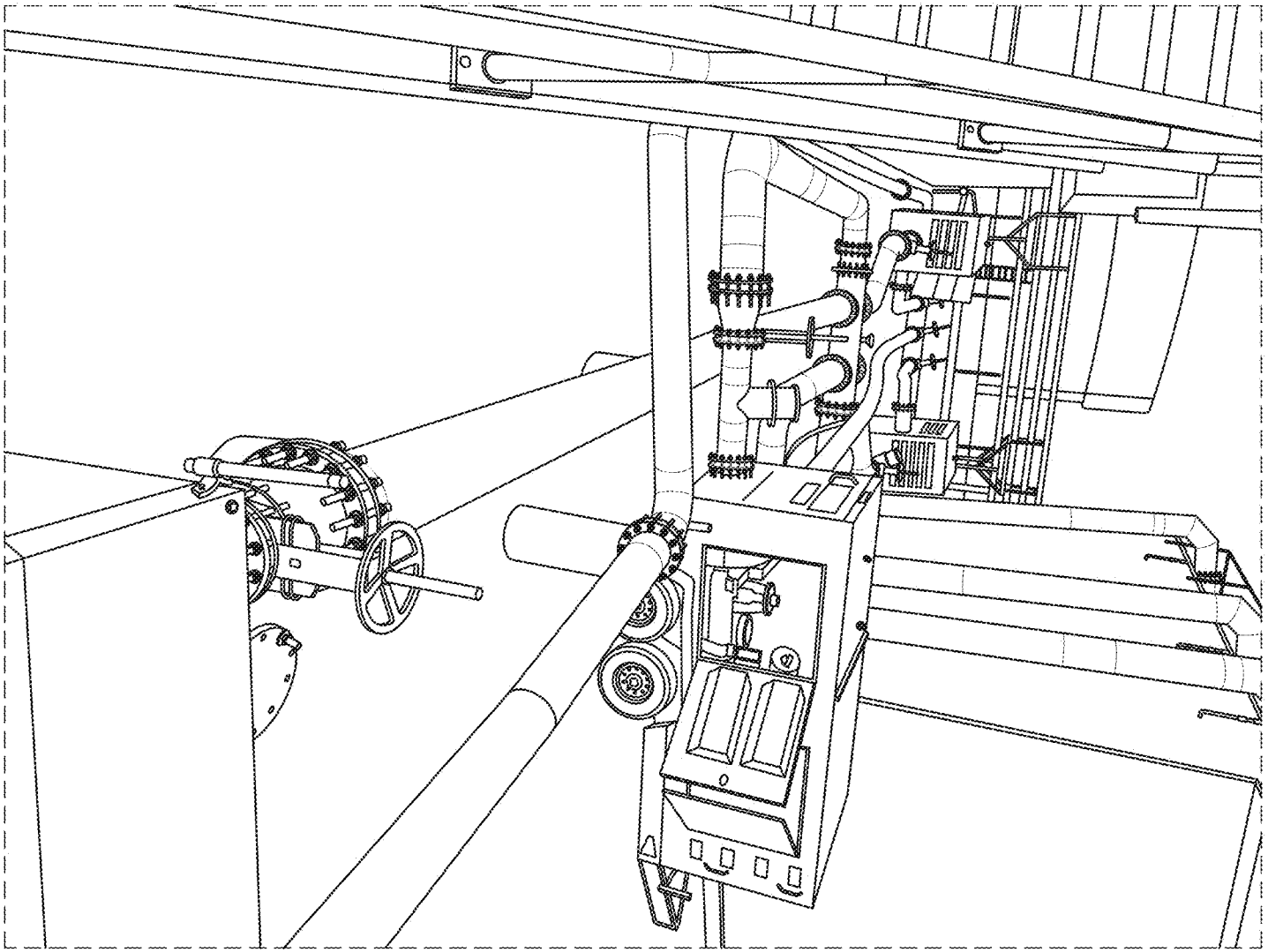
FIG. 1 (Prior Art)

Example embodiments will now be described more fully with reference to the accompanying drawings.

Pumping applications may require multiple pumps for pumping in parallel due to varying flow demands and/or due to only having an inventory of small pumps. Conventionally, an expensive programmable logic controller (PLC) and software is required to provide smart control for managing the multiple pumps to vary the flow. After recognizing the above, exemplary embodiments were developed and/or are disclosed herein that include parallel pumping controllers with load sharing and systems including the same. In exemplary embodiments, a primary controller (e.g., a master/first control panel, etc.) is configured to be operable for controlling its own connected pump and for communicating with other secondary controller(s) (e.g., slave/second control panel(s), etc.) to manage additional pump(s) connected with the secondary controller(s).

In exemplary embodiments disclosed herein, a primary/master controller is configured to be operable (e.g., via "master" code or application programming, etc.) for communicating with and obtaining data from the system's sensor(s), such as sensor data for reservoir level, total flow, etc. The primary/master controller uses the sensor data while managing its own pump and managing the other pump(s) associated with the secondary/slave controller(s), e.g., to achieve a target point, etc. The primary/master controller is also configured to be operable (e.g., via "master" code or application programming, etc.) for managing operational hours across all pumps within the system to share the load so that one pump does not get overused relative to the other pumps. The communications between the primary/master controller and secondary/slave controller(s) may occur wirelessly or via a wired interface. For example, intra-panel or panel-to-panel communications between a primary/master control panel and secondary/slave control panel(s) may occur via Modbus data communications protocol or other wired interface and/or via Bluetooth, Wi-Fi, or other wireless communication protocol.

Exemplary embodiments disclosed herein may provide or include one or more of (but not necessarily any or all of) the following advantages and/or features. For example, exemplary embodiments include a primary controller (e.g., a master/first control panel, etc.) that is operable for controlling its own connected pump and for communicating with other secondary controller(s) (e.g., slave/second control panel(s), etc.) to manage additional pump(s) connected with the secondary controller(s). The panel-to-panel communications may allow for the elimination of a conventional expensive programmable logic controller (PLC) (e.g., PLC 29 (FIGS. 2 and 4), etc.) and its custom software that must otherwise be created by a PLC programmer, which in turn, allow for improvements in total cost and reduced complexity (e.g., elimination of PL to Panel Communications (FIGS. 2 and 4), etc.).

In exemplary embodiments disclosed herein, a system includes one controller configured to be operable as a primary/master controller (e.g., master/primary control panel, etc.) for monitoring and controlling one or more other secondary/slave controllers (e.g. slave/secondary control panel(s), etc.). The primary/master controller is configured to initially use Modbus data communications protocol or other wired interface to handle intercommunications between the primary/master controller and the secondary/slave controller(s).

In exemplary embodiments, the primary/master controller is configured to be operable for starting and stopping all the other pump(s) via communications with the secondary/slave controller(s). The primary/master controller is also configured to be operable for keeping track of the number of engine hours that each pump has run. The engine hour run time for each pump is then used by the primary/master controller to determine which pump(s) to start. The primary/master controller is configured to start the pump that has the lowest number of hours of run time. The primary/master controller is also configured to be operable for determining the number of pumps required to be running at a given time and for controlling the speed of all pumps in the system. And if at least one pump needs to be operating continuously, then the primary/master controller is also configured to sequentially stop and start pumps to keep at least one pump operating. For example, the primary/master controller may stop an operating pump via the operating pump's secondary/slave controller and start an inactive pump via the inactive pump's secondary/slave controller.

Master/Slave Data Synchronization

In exemplary embodiments, the master/primary controller or control unit is configured to be operable with a thread to poll all slave/secondary controller(s) for their system state and configuration. This thread will also be responsible for sending start, stop, and throttle speed requests to the slave/secondary controller(s).

In exemplary embodiments, the following items will be read from each slave/secondary control panel:

1. The operating mode of each slave/secondary control panel to determine if it is available to work.
2. The master state of each slave/secondary control panel to determine if any shutdown faults will prevent it from working.
3. The machine state of each slave/secondary control panel to determine when it has started and its warmup is complete.
4. The slave/secondary control panel's configured minimum and maximum engine speeds.
5. The slave/secondary control panel's reported engine hours.
6. Current engine speed.

Master Panel's Control Thread

In exemplary embodiments, the master/primary controller or control unit is configured, via its master control thread, to make the decisions disclosed herein including the following.

1. The master/primary controller will sit and wait until the thread determines that the master/primary controller needs to start. After determining the need to start, the master/primary controller will determine which pump has the least amount of run time. The master/primary controller will send a request to start to the slave/secondary control panel with the lowest run time.
2. The slave/secondary control panel will start and go through its warmup. After the unit has reached its intermediate speed, the master/primary controller will start overriding the speed. The speed will be based on the configured auto throttle option. The system is also preferably configured with the ability to support maintain modes as well as the regular static run speed.
3. A configuration parameter is provided to enable the master/primary controller to determine the number of units that should be running.
   a. Static Run Speed
      i. With this option there is a setting that selects how many units should run at a time.
      ii. All running units will operate at the configured run speed.
      iii. A stop event on the master/primary controller or control unit will stop all the pumps.
   b. Maintain Mode
      i. The system will start with one pump. This one pump will use the P control loop to maintain the correct speed. If the one pump is running higher than a configurable engine speed percentage for a configured amount of time, the master/primary controller will send a request for an additional unit to start. An additional pump will start anytime the threshold is met until there are no more pumps available.
      ii. The additional unit will warmup and then go to a configured run speed percentage. The additional unit will run constantly at this speed leaving the first pump that started to handle the maintain control loop.
         1. Additionally, the system may be configured with the ability for the units to adjust speed dynamically instead of running at a set speed.

iii. If the first pump is running slower than a configurable engine speed percentage, the master/primary controller will send a request for the unit with the highest hours to shut down.

c. Level Mode i. The number of pumps can be set by level thresholds. The higher/lower the level the more pumps will start and run.

ii. The units will all run at a static speed.

4. If the system never stops working, the system will need the ability to stop a unit that has been running to start a unit that has less hours. This will be determined by comparing the unit with the most hours to the unit with the least hours. If it is above a configured threshold, the system will stop the unit with the most hours and start a unit with the least hours.

a. To complete the hand off, the the pump with the lowest hours will start first. After the unit has completed its warmup, the unit with the highest hours will stop.

b. If the unit that is stopping was the unit used for maintaining, that role will be passed to the running unit with the lowest number of hours. If not, it will go to the static speed set by the master/primary controller.

State Machine Change(s) for Slave/Secondary Control Panel

In exemplary embodiments, the state machine needs a mode where it will only starts/stop based on the start/stop override. Once the unit has started, the unit will go through its warmup and intermediate ramp profiles then stop and wait for override speed request. The slave/secondary control panel(s) is configured to ignore its regular start/stop events.

State Machine Change(s) for Master/Primary Control Panel

In exemplary embodiments, the master/primary control panel is configured to also have the ability to operate like the slave/secondary control panels. But there is a difference in that the start/stop events will be sent to the "Master Panel's Control Thread" instead of to the master/primary control panel's start machine.

In exemplary embodiments, aspects of the present disclosure may be incorporated with or used in combination with Cattron's RemoteIQ™ web-based portal that enables remote monitoring and control of pumps, compressors, generators, and water/wastewater systems. In such exemplary embodiments, support for parallel pumping (PP) may be added to RemoteIQ™ web-based portal by adding a new PP Tab that is available when the master/primary controller reports in with a parallel pumping (PP) license. Only the master/primary controller will report to the PP tab. The slave/secondary controller(s) need not have a PP license or LTE. The PP tab will show the status of the master/primary controller as well as the status of the slave/secondary controller(s) as reported by the master/primary controller. If a slave/secondary controller(s) has LTE, the slave/secondary controller(s) will also report its status through its normal device instance in the RemoteIQ™ web-based portal.

In exemplary embodiments, aspects of the present disclosure may be incorporated with or used in combination with a Bluetooth Device Manager. When the App is connected to a master/primary controller. Master, the App will have the ability to show the status of the master/primary controller as well as the status of the parallel pumping slave/secondary controllers. There could be a new parallel pumping (PP) screen having a specific PP tab.

With reference to the figures, FIG. 1 shows a conventional sewer bypass parallel pumping application in which a programmable logic controller (PLC) is usable for managing four pumps. As disclosed herein, the need for the conventional PLC (and its associated application programming) may be eliminated by using a primary/master control panel (broadly, a first controller or control unit) configured to manage secondary/slave control panel(s) (broadly, second controller(s) or control unit(s)) according to exemplary embodiments of the present disclosure. In such exemplary embodiments, the primary/master control panel is configured to communicate with the secondary/slave control panel(s). And the panel-to-panel communications allow for the elimination of the conventional PLC and the automating of the parallel pumping applications.

For example, a system may include a primary/master control panel and one or more secondary/slave control panels that are each configured to be operable for controlling an engine (e.g., a diesel engine, etc.), which, in turn, is operable for driving (e.g., mechanically spinning, etc.) a pump. In an exemplary embodiment, the system includes six pumps each driven by a diesel engine, which, in turn, includes and/or is controllable by its corresponding control panel (e.g., CANplus™ CP1000 control panel, etc.). In this example, the six diesel engine driven pumps can be automated to control level or flow via the panel-to-panel communications between the primary/master control panel and the five secondary/slave control panels. Continuing with this example, the primary/master control panel is configured to be operable for ensuring that the six diesel engines are evenly used for load balancing (e.g., used substantially the same amount of time, etc.) by selectively determining (e.g., algorithmically via an artificial intelligence (AI) machine learning algorithm(s), via application programming or software, etc.) which pump(s) should be running and thereafter selecting starting and stopping the corresponding pumps. In the above example, the system included six pumps and six control panels. But other exemplary embodiments systems may include more or less than six pumps and six control panels.

Figure 3:
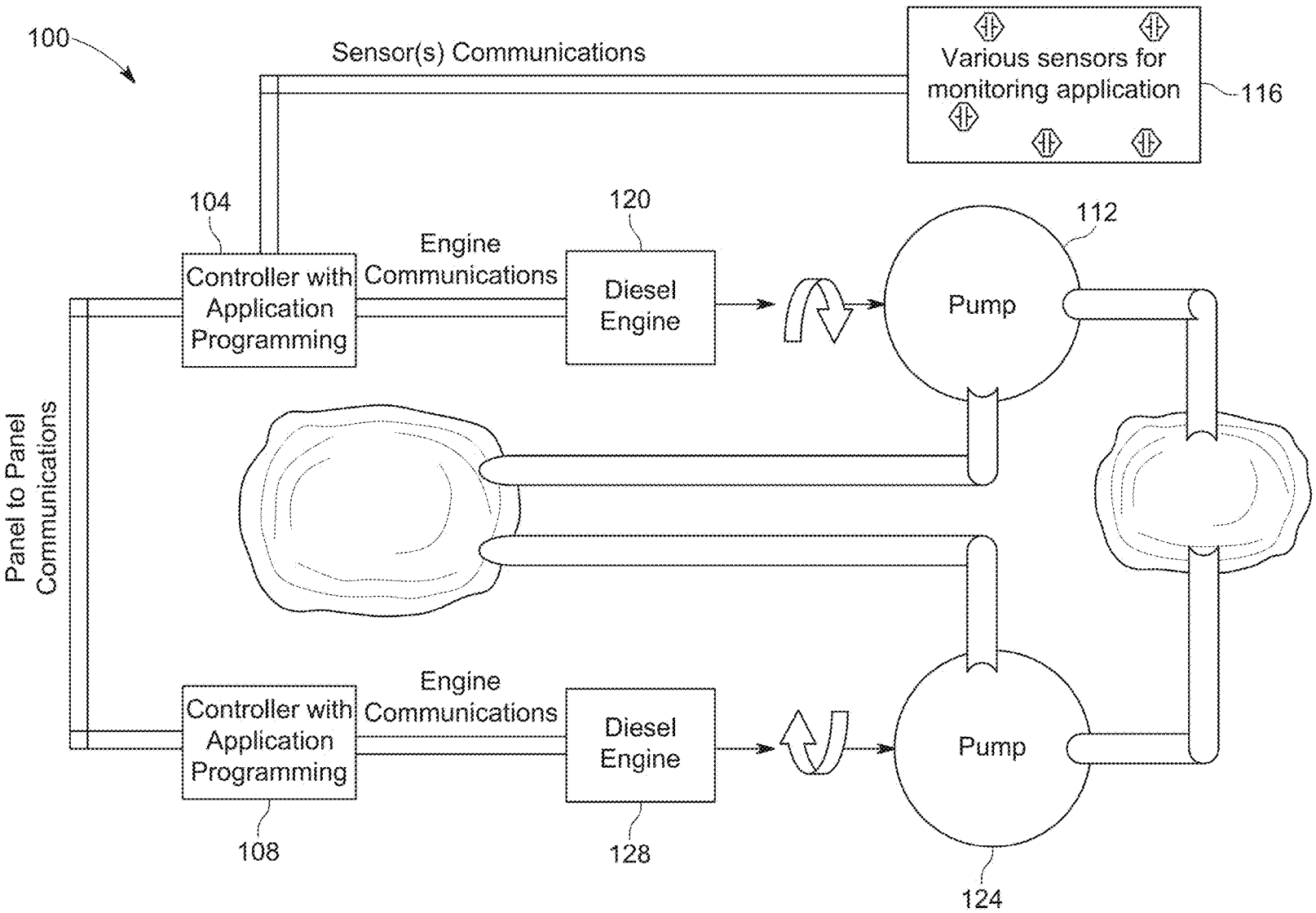

FIG. 3 illustrates an exemplary embodiment of a system 100 including a primary/master controller 104 configured to communicate with and manage a secondary/slave controller 108. In this exemplary embodiment, the primary/master controller 104 is configured to control operation (e.g., start, stop, throttle speed, etc.) of a first pump 112, e.g., in response to or based on the primary/master controller's communications with sensors 116. The primary/master controller 104 may send commands to the electronic control unit (ECU) of the first diesel engine 120 (e.g., via a controller area network (CAN), etc.) for controllably changing the speed of the first diesel engine 120 that is driving the first pump 112.

The primary/master controller 104 is also configured to communicate directly with (e.g., via ModBus data communications protocol, etc.) to the secondary/slave controller 108 for controlling operation (e.g., start, stop, throttle speed, etc.) of a second pump 124. In response to the communications from the primary/master controller 104, the secondary/slave controller 108 may send commands to the electronic control unit (ECU) of the second diesel engine 128 (e.g., via a controller area network (CAN), etc.) for controllably changing the speed of the second diesel engine 128 that is driving the second pump 124. The primary/master controller 104 may communicate directly with the secondary/slave controller 108 for controlling operation of the second diesel engine 128 for ensuring that the first and second diesel engines 120, 128 are substantially evenly used for load sharing (e.g., used substantially the same amount of time, etc.).

A communication link (e.g., hard wired connection, wireless connection, etc.) is provided from the primary/master controller 104 to the secondary/slave controller 108. For example, a single cable or other suitable communication link may be provided from the primary/master controller 104 to the secondary/slave controller 108. The primary/master controller 104 is configured to be operable for monitoring the one or more sensors 116. In response to the sensor output (e.g., received via a hard wired connection, wireless connection, etc.), the primary/master controller 104 is configured to be operable controlling the first diesel engine 120 and for communicating with the slave/secondary controller 108 for controlling the second diesel engine 128.

Figure 2:
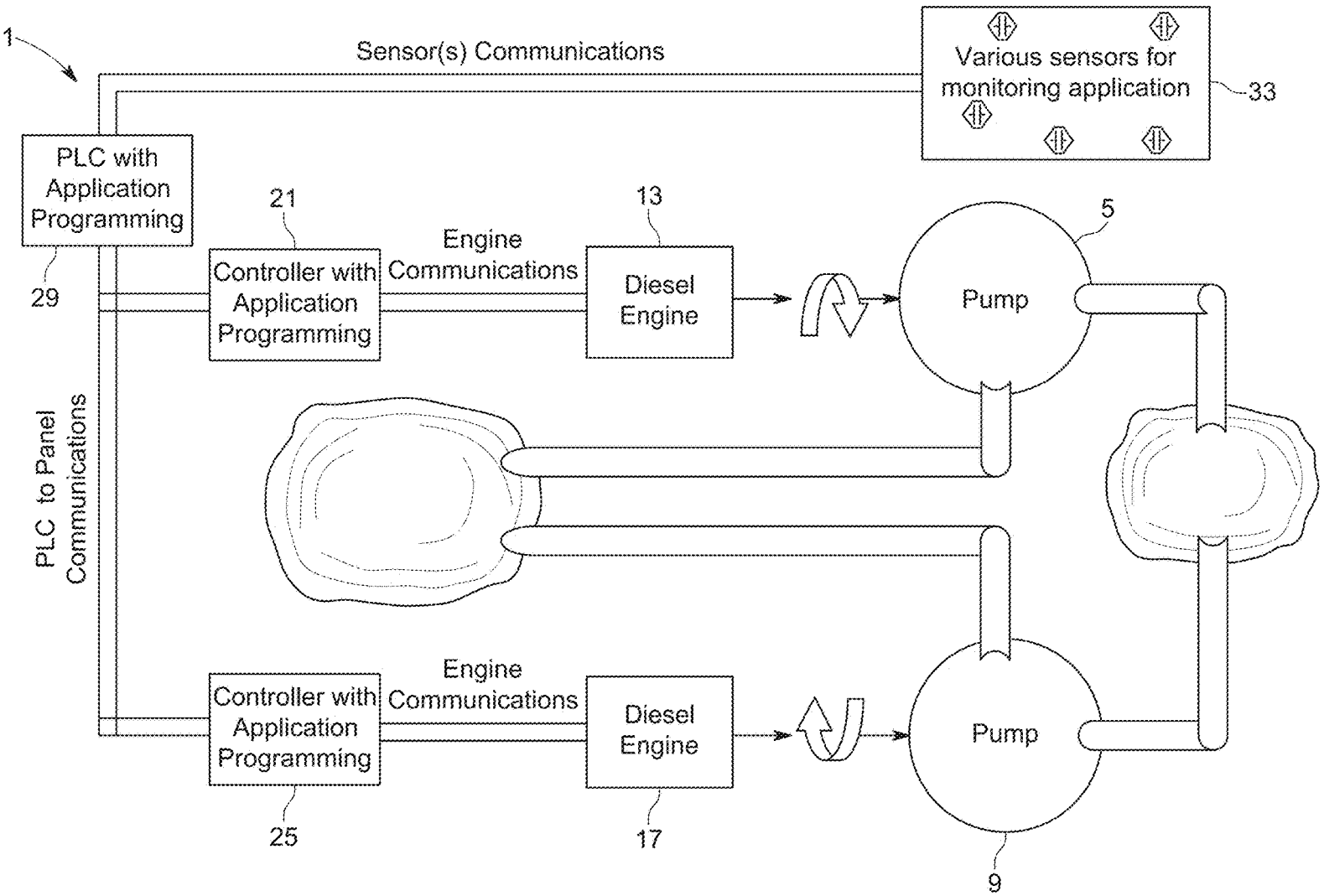
FIG. 2 (Prior Art)
Figure 4:
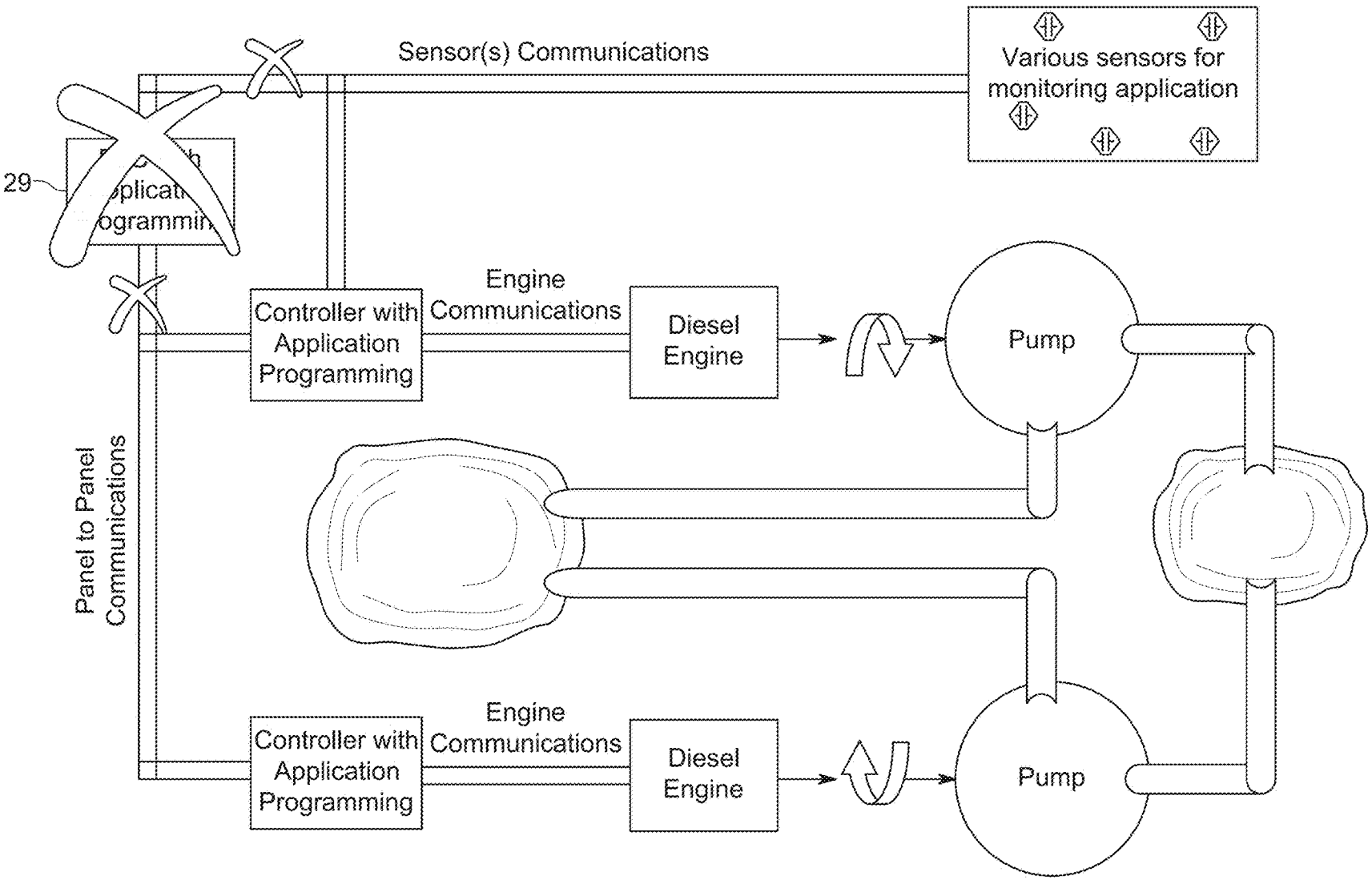
FIG. 4 illustrates various components (e.g., PLC, the PLC's application programming, and the PLC to Panel Communications) that may be eliminated from the conventional system shown in FIG. 2 as compared to the exemplary embodiment of the system shown in FIG. 3, which includes a primary/master controller configured for communication with sensors and a secondary/slave controller.

FIG. 4 illustrates various components (e.g., PLC 29 and its application) that may be eliminated from the conventional system 1 shown in FIG. 2 as compared to the exemplary embodiment of the system 100 shown in FIG. 3. As shown in FIG. 4, the PLC 29 may be eliminated along with the communication links for the non-existent eliminated PLC 29.

Figure 5B:
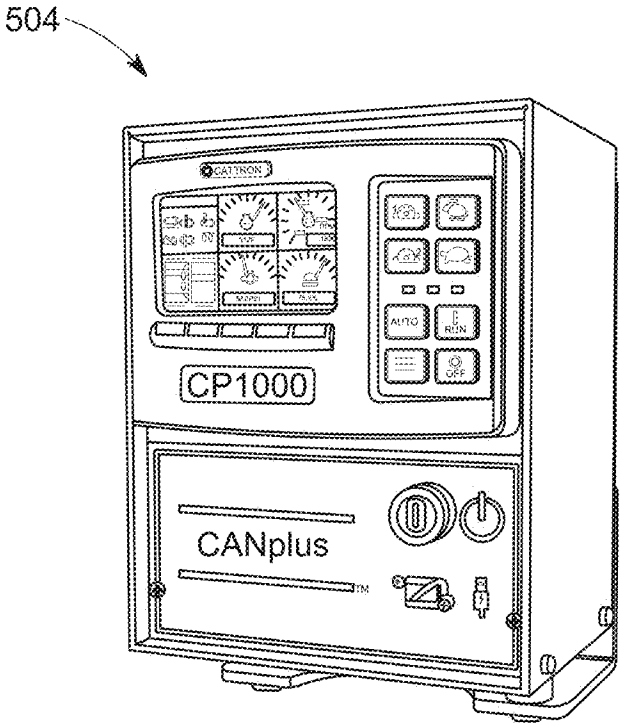
FIGS. 5A and 5B show an example CANplus™ CP1000 control panel that may be configured (e.g., algorithmically configured via an algorithm, provided with application programming or software, etc.) to be operable as primary/master controller in exemplary embodiments of the present disclosure.
Figure 5A:
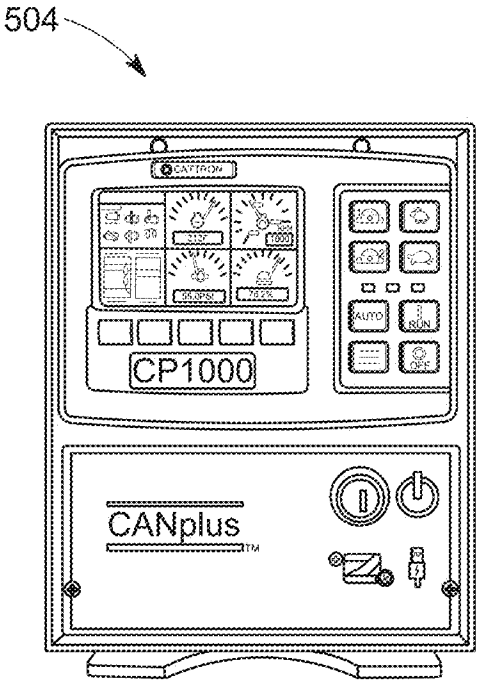

By way of example, a controller disclosed herein (e.g., primary/master controller 104 (FIG. 3), etc.) may comprise a CANplus™ CP1000 control panel 504 (FIGS. 5A and 5B) that is configured (e.g., algorithmically configured via an algorithm, provided with application programming or software, etc.) to be operable as disclosed herein, e.g., for controlling operating of its own pump and for communicating with one or more other secondary/slave controller(s) for controlling operation of additional pump(s), e.g., to ensure substantially even use for load sharing (e.g., used substantially the same amount of time, etc.). In such exemplary embodiments, the controller may include one or more features as disclosed in Appendix A to U.S. Provisional Patent Application No. 63/465,765 filed May 11, 2023. The contents of U.S. Provisional Patent Application No. 63/465,765 including its Appendix A are incorporated herein by reference in its entirety. Exemplary embodiments may include a control panel having one or more features identical to or similar to a CANplus™ CP1000 control panel. For example, an exemplary embodiment may include a control panel that is a manual and autostart platform for electronically governed diesel or natural gas engines. The control panel may also or instead be configured to control mechanically governed diesel engines. The control panel may be configured to display graphical quad-gauge pages on a 4.3" diagonal WQVGA (480×272 pixels) liquid crystal display (LCD). The control panel may be configured to display SAE J1939 parameters reported by an ECU (Engine Control Unit), including, but not limited to the following: RPM, coolant temperature, oil pressure, engine hours, voltage, exhaust emissions system state and diagnostic codes. The backlit display of the control panel may be clearly readable in bright sunlight and total darkness and may be housed in a rugged IP66 rated housing. The control panel may include LEDs (e.g., three LEDs, etc.) to indicate Faults and Warnings, Emission-Related Alerts and Autostart active. The control panel may include display keys (e.g., five display keys, etc.) that are associated with a dynamic Display Key bar as well as control buttons (e.g., eight control buttons, etc.). The control panel may feature automatic start/stop control and start/stop modes using an Event Manager, which can start or stop based on any of the digital inputs, analog transducer inputs (e.g., six 4-20 mA analog transducer inputs, etc.), a real time clock, or combinations of date/time and analog or digital inputs. With the use of a transducer, the control panel may have a "cruise control" feature that automatically throttles the engine to maintain a configurable level. The control panel may be configured to use any one of the transducer inputs for the maintain/cruise control feature, regardless of whether that input is also being used as a start or stop event. The description in this paragraph of possible features that may be included with a control panel is provided for purpose of illustration and example only. In alternative exemplary embodiments, the control panel is configured differently, e.g., without one or more the feature(s) described in this paragraph, with different features and/or additional features than the features described in this paragraph, etc.

Accordingly, exemplary embodiments are disclosed herein of parallel pumping controllers (e.g., control panels, etc.) with load sharing and systems including such parallel pumping controllers.

In exemplary embodiments, a system includes a first pump, a second pump, a first engine configured to be operable for driving the first pump, and a second engine configured to be operable for driving the second pump. A first controller is configured for communication with the first engine for controlling operation of the first pump via the first engine. A second controller is configured for communication with the second engine for controlling operation of the second pump via the second engine. The first controller is further configured for communication with the second controller, whereby the first controller is operable for controlling operation of the first pump via the first engine and for controlling operation of the second pump via communications with the second controller, which responsively controls operation of the second engine according to the communications from the first controller.

In exemplary embodiments, the first controller comprises a primary engine control panel. And the second controller comprises a secondary engine control panel controllably responsive to commands and/or instructions from the primary engine control panel.

In exemplary embodiments, the first controller comprises a master engine control panel. And the second controller comprises a slave engine control panel controllably responsive to commands and/or instructions from the master engine control panel.

In exemplary embodiments, the first controller is operable for controlling operation of both the first and second engines such that the first and second engines are used substantially a same amount of time for load sharing.

In exemplary embodiments, the first controller is configured to be operable for obtaining data from one or more sensors of the system. And the first controller is configured to be operable for using the data from the one or more sensors for managing operation of the first and second pumps for achieving one or more targets.

In exemplary embodiments, the first controller is configured to be operable for managing operational hours across all pumps within the system for sharing the load and avoiding overuse of any pump relative to the other pumps.

In exemplary embodiments, the first controller is configured to be operable for tracking engine hours and determining which pump(s) to start and which pump(s) to turn off based on the tracked engine hours.

In exemplary embodiments, the first controller is configured to be operable for starting pump(s) having the lowest number of hours of run time.

In exemplary embodiments, the first controller is configured to be operable for determining the number of pumps required to be running at a given time and for controlling the speed of all pumps in the system.

In exemplary embodiments, the first controller is configured to be operable for sequentially stopping and starting pumps to keep at least one pump operating if at least one pump needs to be operating continuously by having the pump with the lowest hours starting first and completing its warmup before shutting down the pump with the highest hours.

In exemplary embodiments, the first controller is configured to operable for sending start, stop, and throttle speed requests to the first engine and for sending start, stop, and throttle speed requests to the second engine via the second controller.

In exemplary embodiments, the first controller is configured to obtain from each second controller: operating mode of each second controller to determine its availability to work; master state of each second controller to determine if any shutdown faults will prevent it from working; machine state of each second controller to determine when it has started and whether its warmup is complete; each second controller's configured minimum and maximum engine speeds; each second controller's reported engine hours; and current engine speed.

In exemplary embodiments, the first controller is provided a configuration parameter to enable the first controller to determine a number of pumps that should be running. The configuration parameter includes one or more of a static run speed and/or a maintain mode. For the static run speed, a setting selects how many pumps should run at a time, all running pumps will operate at a configured run speed, and a stop event on the first controller will stop all pumps. For the maintain mode, the system will start with a first pump. And if the first pump is running higher than a configurable engine speed percentage for a configured amount of time, the first controller will send a request for an additional pump to start. And if the first pump is running slower than a configurable engine speed percentage, the first controller will send a request for the pump with the highest hours to shut down.

In exemplary embodiments, the system is configured such that the first and second pumps are operable for pumping in parallel.

In exemplary embodiments, the first engine is a diesel engine operable for mechanically spinning the first pump. And the second engine is a diesel engine operable for mechanically spinning the second pump.

In exemplary embodiments, the second pump, the second engine, and the second controller respectively comprise a plurality of second pumps, a plurality of second engines, and a plurality of second controllers.

Also disclosed are exemplary methods for controlling operation of multiple pumps in a parallel pumping application. In exemplary embodiments, the method comprises: controlling operation of a first pump via a first controller communicating with a first engine operable for driving the first pump; and controlling operation of a second pump via the first controller communicating with a second controller, which responsively controls operation of a second engine operable for driving the second pump according to the communications from the first controller.

In exemplary embodiments, the method includes controlling operation of the first and second engines such that the first and second engines are used substantially a same amount of time for load sharing.

In exemplary embodiments of the method, the first controller comprises a primary engine control panel. And the second controller comprises a secondary engine control panel controllably responsive to commands and/or instructions from the primary engine control panel.

In exemplary embodiments of the method, the first controller comprises a master engine control panel. And the second controller comprises a slave engine control panel controllably responsive to commands and/or instructions from the master engine control panel.

In exemplary embodiments, the method includes: obtaining data from one or more sensors; and using the data from the one or more sensors for managing operation of the first and second pumps, via the first and second controllers, for achieving one or more targets.

In exemplary embodiments, the method includes using the first controller for managing operational hours across all pumps for sharing the load and avoiding overuse of any pump relative to the other pumps.

In exemplary embodiments, the method includes using the first controller for tracking engine hours and determining which pump(s) to start and which pump(s) to turn off based on the tracked engine hours.

In exemplary embodiments, the method includes using the first controller for starting pump(s) having the lowest number of hours of run time.

In exemplary embodiments, the method includes using the first controller for determining the number of pumps required to be running at a given time and for controlling the speed of all pumps in the system.

In exemplary embodiments, the method includes using the first controller for sequentially stopping and starting pumps to keep at least one pump operating if at least one pump needs to be operating continuously by having the pump with the lowest hours starting first and completing its warmup before shutting down the pump with the highest hours.

In exemplary embodiments, the method includes the first controller: sending start, stop, and throttle speed requests to the first engine; and sending start, stop, and throttle speed requests to the second engine via the second controller.

In exemplary embodiments, the method includes the first controller obtaining from each second controller: operating mode of each second controller to determine its availability to work; master state of each second controller to determine if any shutdown faults will prevent it from working; machine state of each second controller to determine when it has started and whether its warmup is complete; each second controller's configured minimum and maximum engine speeds; each second controller's reported engine hours; and current engine speed.

In exemplary embodiments, the method includes the first controller obtaining a configuration parameter to enable the first controller to determine a number of pumps that should be running. The configuration parameter includes one or more of a static run speed and/or a maintain mode. For the static run speed, a setting selects how many pumps should run at a time, all running pumps will operate at a configured run speed, and a stop event on the first controller will stop all pumps. For the maintain mode, the system will start with a first pump. And if the first pump is running higher than a configurable engine speed percentage for a configured amount of time, the first controller will send a request for an additional pump to start. And if the first pump is running slower than a configurable engine speed percentage, the first controller will send a request for the pump with the highest hours to shut down.

In exemplary embodiments, a controller (e.g., an engine control panel, etc.) is configured to be operable for performing a method as disclosed herein.

In exemplary embodiments, a non-transitory computer-readable storage media includes executable instructions, that when executed by at least one processor, cause a first controller to: control operation of a first pump via a first engine operable for driving the first pump; and control operation of a second pump via communications with a second controller, which responsively controls operation of a second engine operable for driving the second pump according to the communications from the first controller.

In exemplary embodiments of the non-transitory computer-readable storage media, the executable instructions include executable instructions that when executed by the at least one processor, cause the first controller to control operation of the first and second engines such that the first and second engines are used substantially a same amount of time for load sharing.

In exemplary embodiments of the non-transitory computer-readable storage media, the executable instructions include executable instructions that when executed by the at least one processor, cause the first controller to: obtain data from one or more sensors; and use the data from the one or more sensors for managing operation of the first and second pumps for achieving one or more targets.

In exemplary embodiments of the non-transitory computer-readable storage media, the executable instructions include executable instructions that when executed by the at least one processor, cause the first controller to manage operational hours across all pumps for sharing the load and avoiding overuse of any pump relative to the other pumps.

In exemplary embodiments of the non-transitory computer-readable storage media, the executable instructions include executable instructions that when executed by the at least one processor, cause the first controller to track engine hours and determine which pump(s) to start and which pump(s) to turn off based on the tracked engine hours.

In exemplary embodiments of the non-transitory computer-readable storage media, the executable instructions include executable instructions that when executed by the at least one processor, cause the first controller to start pump(s) having the lowest number of hours of run time. In exemplary embodiments of the non-transitory computer-readable storage media, the executable instructions include executable instructions that when executed by the at least one processor, cause the first controller to determine the number of pumps required to be running at a given time and to control the speed of all pumps in the system.

In exemplary embodiments of the non-transitory computer-readable storage media, the executable instructions include executable instructions that when executed by the at least one processor, cause the first controller to sequentially stop and start pumps to keep at least one pump operating if at least one pump needs to be operating continuously by having the pump with the lowest hours start first and completing its warmup before shutting down the pump with the highest hours.

In exemplary embodiments of the non-transitory computer-readable storage media, the executable instructions include executable instructions that when executed by the at least one processor, cause the first controller to send start, stop, and throttle speed requests to the first engine and to send start, stop, and throttle speed requests to the second engine via the second controller.

In exemplary embodiments of the non-transitory computer-readable storage media, the executable instructions include executable instructions that when executed by the at least one processor, cause the first controller to obtain from each second controller: operating mode of each second controller to determine its availability to work; master state of each second controller to determine if any shutdown faults will prevent it from working; machine state of each second controller to determine when it has started and whether its warmup is complete; each second controller's configured minimum and maximum engine speeds; each second controller's reported engine hours; and current engine speed.

In exemplary embodiments of the non-transitory computer-readable storage media, the executable instructions include executable instructions that when executed by the at least one processor, cause the first controller to obtain a configuration parameter to enable the first controller to determine a number of pumps that should be running. The configuration parameter includes one or more of a statis run speed and/or a maintain mode. For the static run speed, a setting selects how many pumps should run at a time, all running pumps will operate at a configured run speed, and a stop event on the first controller will stop all pumps. For the maintain mode, the system will start with a first pump. And if the first pump is running higher than a configurable engine speed percentage for a configured amount of time, the first controller will send a request for an additional pump to start. And if the first pump is running slower than a configurable engine speed percentage, the first controller will send a request for the pump with the highest hours to shut down.

In exemplary embodiments, a controller (e.g., an engine control panel, etc.) includes at least one processor and a non-transitory computer-readable storage media as disclosed herein.

The exemplary embodiments disclosed herein may be used in various types of systems, including water supply systems, wastewater systems (e.g., a sewer system bypass, sewer lift station, etc.), flood water management systems, etc. But the exemplary embodiments disclosed herein may also be used in other systems and are not limited to use in any one particular type of system, motor, engine, or machine.

Exemplary embodiments disclosed herein may include one or more (but not necessarily any or all) of the following innovative features:

- Master-Slave Architecture: a primary controller manages secondary controllers without a central PLC;
- Engine Hour-Based Load Sharing: pumps are started/stopped based on usage history to balance wear;
- Sensor-Driven Control: real-time data from sensors used to optimize pump operation;
- Multiple Control Modes: static, maintain, and level-based modes for flexible operation;
- Panel-to-Panel Communication: wired or wireless protocols for decentralized control; and/or
- Machine Learning Integration: predictive algorithms for system optimization.

Exemplary embodiments disclosed herein may include one or more (but not necessarily any or all) of the following:

- Elimination of centralized PLCs;
- Distributed control architecture;
- Intelligent load sharing based on engine hours;
- Advanced control modes and sensor integration; and/or
- Machine learning for predictive control.

Exemplary embodiments may include a distributed control architecture that replaces conventional centralized PLC systems with a primary/master controller that directly manages secondary/slave controllers. The distributed control architecture may enable panel-to-panel communication (wired or wireless), reducing cost and complexity.

Exemplary embodiments may include load sharing based on engine hours. In such exemplary embodiments, the system may tracks engine runtime hours for each pump. The pumps may be started/stopped based on least-used logic, ensuring balanced wear and extended equipment life.

Exemplary embodiments may include multi-mode operation that supports multiple control strategies including: static run speed (fixed number of pumps at a set speed), maintain mode (dynamically add/remove pumps based on performance thresholds), and level mode (activate pumps based on fluid level thresholds).

Exemplary embodiments may include sensor-driven optimization. This may include integration with sensors (e.g., flow, level) to make real-time decisions and use of sensor data to manage pump speed, activation, and shutdown for target performance.

Exemplary embodiments may include intelligent control logic. This may implementation of control threads and state machines for both master and slave panels. This may enable seamless synchronization, warmup coordination, and override handling.

Exemplary embodiments may include machine learning integration, such as the use of AI algorithms to learn optimal operating parameters. The machine learning may enhance predictive control and fault detection across full operational ranges.

Exemplary embodiments may include remote monitoring and configuration. For example, exemplary embodiments may be compatible with RemoteIQ™ web portal and Bluetooth Device Manager. Exemplary embodiments may allow remote visibility and control of master and slave panels.

Exemplary embodiments may also include one or more of the following:

- Cumulative engine/operational hour tracking & rotation (load balancing unique to pumps);
- Mode control (Maintain, Level, Static Run Speed, Flow) specific to liquid transfer, not HVAC;
- Controller-to-controller networking without PLC; and
- Control activation and deactivation of pumps according to at least one of: a maintain mode in which pumps are added or removed in response to load such as flow, a level mode in which pumps are activated or deactivated based on fluid reservoir thresholds; and a static run speed mode in which pumps are operated at a constant speed regardless of load.

As will be appreciated based on the foregoing specification, the above-described embodiments of the disclosure may be implemented using computer programming or engineering techniques including computer software, firmware, hardware, or any combination or subset thereof, wherein the technical effect may be achieved by performing the following operations: a controller learning, via machine learning, an acceptable level for a parameter to be monitored across a full operational range of the system component, thereby enabling the controller to be operable for detecting an issue(s) or problem(s) associated with the monitored parameter within the full operational range of a system component.

Exemplary embodiments may include one or more processors and memory coupled to (and in communication with) the one or more processors. A processor may include one or more processing units (e.g., in a multi-core configuration, etc.) such as, and without limitation, a central processing unit (CPU), a microcontroller, a reduced instruction set computer (RISC) processor, an application specific integrated circuit (ASIC), a programmable logic device (PLD), a gate array, and/or any other circuit or processor capable of the functions described herein.

It should be appreciated that the functions described herein, in some embodiments, may be described in computer executable instructions stored on a computer readable media, and executable by at least one processor. The computer readable media is a non-transitory computer readable storage medium. By way of example, and not limitation, such computer-readable media can include dynamic random access memory (DRAM), static random access memory (SRAM), read only memory (ROM), erasable programmable read only memory (EPROM), solid state devices, flash drives, CD-ROMs, thumb drives, floppy disks, tapes, hard disks, other optical disk storage, magnetic disk storage or other magnetic storage devices, any other type of volatile or nonvolatile physical or tangible computer-readable media, or other medium that can be used to carry or store desired program code in the form of instructions or data structures and that can be accessed by a computer. Combinations of the above should also be included within the scope of computer-readable media.

Computer-executable instructions may be stored in the memory for execution by a processor to particularly cause the processor to perform one or more of the functions described herein, such that the memory is a physical, tangible, and non-transitory computer readable storage media. Such instructions often improve the efficiencies and/or performance of the processor that is performing one or more of the various operations herein. It should be appreciated that the memory may include a variety of different memories, each implemented in one or more of the functions or processes described herein.

It should also be appreciated that one or more aspects of the present disclosure transform a general-purpose computing device into a special-purpose computing device when configured to perform the functions, methods, and/or processes described herein.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising:

a first controller configured for communication with a first engine for controlling operation of a first pump via the first engine; and a second controller configured for communication with a second engine for controlling operation of a second pump via the second engine;

wherein the first controller is further configured for communication with the second controller, whereby the first controller is operable for controlling operation of the first pump via the first engine and for controlling operation of the second pump via communications with the second controller, which responsively controls operation of the second engine according to the communications from the first controller; and wherein the first controller is provided a configuration parameter to enable the first controller to determine a number of pumps that should be running, the configuration parameter includes one or more of:

static run speed for which a setting selects how many pumps should run at a time, all running pumps will operate at a configured run speed, and a stop event on the first controller will stop all pumps; and/or a maintain mode in which the system will start with one pump, and:

if the one pump is running higher than a configurable engine speed percentage for a configured amount of time, the first controller will send a request for an additional pump to start; and if the first pump is running slower than a configurable engine speed percentage, the first controller will send a request for the pump with the highest hours to shut down.

2. The system of claim 1, wherein:

the first controller comprises a primary engine control panel; and the second controller comprises a secondary engine control panel controllably responsive to commands and/or instructions from the primary engine control panel;

whereby the first controller is operable for managing the second controller via controller-to-controller communications without a centralized programmable logic controller (PLC).

3. The system of claim 1, wherein:

the first controller comprises a master engine control panel; and the second controller comprises a slave engine control panel controllably responsive to commands and/or instructions from the master engine control panel;

whereby the master engine control panel is operable for managing the slave engine control panel via panel-to-panel communications without a centralized programmable logic controller (PLC).

4. The system of claim 1, wherein the first controller is operable for controlling operation of both the first and second engines such that the first and second engines are used substantially a same amount of time for engine hour based load sharing.

5. The system of claim 1, wherein:

the first controller is configured to be operable for obtaining real-time data from one or more sensors of the system; and the first controller is configured to be operable for making real-time decisions using the real-time data from the one or more sensors for managing and/or optimizing operation of the first and second pumps for achieving one or more targets.

6. The system of claim 1, wherein the first controller is configured to be operable for managing operational hours across all pumps within the system for engine hour based load sharing and avoiding overuse of any pump relative to the other pumps.

7. The system of claim 1, wherein the first controller is configured to be operable for tracking engine hours and determining which pump(s) to start and which pump(s) to turn off based on the tracked engine hours.

8. The system of claim 1, wherein the first controller is configured to be operable for starting pump(s) having the lowest number of hours of run time.

9. The system of claim 1, wherein the first controller is configured to be operable for determining the number of pumps required to be running at a given time and for controlling the speed of all pumps in the system.

10. A system comprising:

a first controller configured for communication with a first engine for controlling operation of a first pump via the first engine; and a second controller configured for communication with a second engine for controlling operation of a second pump via the second engine;

wherein the first controller is further configured for communication with the second controller, whereby the first controller is operable for controlling operation of the first pump via the first engine and for controlling operation of the second pump via communications with the second controller, which responsively controls operation of the second engine according to the communications from the first controller; and wherein the first controller is configured to be operable for sequentially stopping and starting pumps to keep at least one pump operating if at least one pump needs to be operating continuously by having the pump with the lowest hours starting first and completing its warmup before shutting down the pump with the highest hours.

11. The system of claim 1, wherein the first controller is configured to operable for sending start, stop, and throttle speed requests to the first engine and for sending start, stop, and throttle speed requests to the second engine via the second controller.

12. The system of claim 1, wherein:

the system is configured such that the first and second pumps are operable for pumping in parallel; and/or the second pump, the second engine, and the second controller respectively comprise a plurality of second pumps, a plurality of second engines, and a plurality of second controllers.

13. The system of claim 1, wherein:

the first engine is a diesel engine operable for mechanically spinning the first pump; and the second engine is a diesel engine operable for mechanically spinning the second pump.

14. The system of claim 1, wherein the system further includes the first pump, the second pump, the first engine configured to be operable for driving the first pump, and the second engine configured to be operable for driving the second pump.

15. A system comprising:

a first controller configured for communication with a first engine for controlling operation of a first pump via the first engine; and a second controller configured for communication with a second engine for controlling operation of a second pump via the second engine;

wherein the first controller is further configured for communication with the second controller, whereby the first controller is operable for controlling operation of the first pump via the first engine and for controlling operation of the second pump via communications with the second controller, which responsively controls operation of the second engine according to the communications from the first controller; and wherein the first controller is configured to obtain from each second controller:

operating mode of each second controller to determine its availability to work;

master state of each second controller to determine if any shutdown faults will prevent it from working;

machine state of each second controller to determine when it has started and whether its warmup is complete;

each second controller's configured minimum and maximum engine speeds;

each second controller's reported engine hours; and current engine speed.

16. The system of claim 15, wherein the first controller is provided a configuration parameter to enable the first controller to determine a number of pumps that should be running, the configuration parameter includes one or more of:

static run speed for which a setting selects how many pumps should run at a time, all running pumps will operate at a configured run speed, and a stop event on the first controller will stop all pumps; and/or a maintain mode in which the system will start with one pump, and:

if the one pump is running higher than a configurable engine speed percentage for a configured amount of time, the first controller will send a request for an additional pump to start; and if the first pump is running slower than a configurable engine speed percentage, the first controller will send a request for the pump with the highest hours to shut down.

17. The system of claim 15, wherein the system is configured to control activation and deactivation of pumps according to at least one of:

a maintain mode in which pumps are added or removed in response to load such as flow;

a level mode in which pumps are activated or deactivated based on fluid reservoir thresholds; and a static run speed mode in which pumps are operated at a constant speed regardless of load.

18. A system comprising:

a first controller configured for communication with a first engine for controlling operation of a first pump via the first engine; and a second controller configured for communication with a second engine for controlling operation of a second pump via the second engine;

wherein the first controller is further configured for communication with the second controller, whereby the first controller is operable for controlling operation of the first pump via the first engine and for controlling operation of the second pump via communications with the second controller, which responsively controls operation of the second engine according to the communications from the first controller; and wherein the system is configured for multi-mode operation including:

a static run speed mode in which pumps are operated at a set speed regardless of load;

a maintain mode in which pumps are dynamically added or removed based on performance thresholds; and a level mode in which pumps are activated or deactivated based on fluid level thresholds.

* * * * *